United States Patent [19]

Tanov

[11] 3,949,819

[45] Apr. 13, 1976

[54] SOIL SAMPLING DEVICE

[76] Inventor: Evgeny Ivanovich Tanov, ulitsa Dzerzhinskogo, 34, Ashkhabad Turkmenskoi SSR, U.S.S.R.

[22] Filed: July 10, 1974

[21] Appl. No.: 487,393

[52] U.S. Cl. ..... 175/243; 175/245; 175/250

[51] Int. Cl.[2] ..... E21B 25/00; E21B 9/20

[58] Field of Search ..... 175/232, 233, 239, 240, 175/243, 245, 249, 250, 253

[56] References Cited

UNITED STATES PATENTS

| | | | |
|---|---|---|---|
| 2,893,691 | 7/1959 | Johnson | 175/250 X |
| 2,915,284 | 12/1959 | Ortloff | 175/250 X |
| 3,480,093 | 11/1969 | Clynch | 175/250 X |
| 3,525,409 | 8/1970 | Holzman | 175/245 |
| 3,621,924 | 11/1971 | Lebourg | 175/243 X |
| 3,640,354 | 2/1972 | Rassieur | 175/243 |
| 3,837,412 | 9/1974 | Driver | 175/253 X |

FOREIGN PATENTS OR APPLICATIONS

| | | | |
|---|---|---|---|
| 198,269 | 4/1966 | U.S.S.R. | 175/250 |

*Primary Examiner*—David H. Brown

*Attorney, Agent, or Firm*—Haseltine, Lake & Waters

[57] ABSTRACT

A device for taking soil samples from a hole drilled in the ground by another tool, and for drilling shallow holes. The device comprises a pneumatic impact mechanism rigidly connected with a soil sampling socket provided with an appliance for holding the soil sample in the socket when the latter is being extracted from the hole. This appliance is made in the form of an elastic inflatable element which, being inflated with compressed gas, covers completely the inner cross-sectional area of the socket, thus making it possible to take complete and high-quality samples irrespective of the type and condition of the soil.

3 Claims, 3 Drawing Figures

SOIL SAMPLING DEVICE

The present invention relates generally to implements used in engineering geological and geological prospecting work and more particularly it relates to soil sampling devices.

This invention can be used to advantage on construction projects, in geological research and in other fields which require information on the composition, stratification and state of the soil.

This invention can be used most successfully for taking soil samples and drilling comparatively shallow (approximately up to 30 m), holes in friable and loose soils.

Widely known in the previous art is a soil sampling device comprising a pneumatic impact mechanism rigidly connected with a soil sampling socket or two sockets provided with appliances located near the ends of the sockets and intended to hold the soil samples in the sockets while the latter are being extracted from the hole.

The pneumatic impact mechanism of the known device has a hollow casing accommodating a gas distributing device. The casing is provided with a rigidly secured tapered point carrying a rigidly fastened adapter which is made integral with a cross arm on which two soil sample sockets are installed. Thus, the sockets are located diametrically opposite to the casing of the pneumatic impact mechanism and the longitudinal axes of both sockets and of the casing are parallel to each other. The soil sampling sockets have pointed ends for better penetration into the ground.

Located near the end of each socket is an appliance intended to hold the soil sample in said socket while the latter is being extracted from the hole. This appliance is constituted by a number of rectangular curved plates arranged uniformly around the circumference and fastened at one end to the inner surface of the socket. The other end of each plate is curved towards the socket axis. While the socket is being driven into the ground, column of the sampled soil forces the curved portions of the plates towards the walls of the socket. After driving the sockets into the ground and extracting the device from the hole the bent portions of the plates return to their initial positions.

As a result, the soil sample in the socket rests on the bent portions of the plates and is thereby held in the socket while the device is being lifted out of the hole. Such a device is intended to hold the sample of a coherent rock since its plates do not cover the entire cross section of the socket. In case of running and loose, e.g. water-saturated soils, the sample column will break up and fall out partly, thus denying the possibility of obtaining a complete and high-quality soil sample.

This constitutes a considerable disadvantage of the known soil sampling device. Besides, extraction of the device from the hole with the working pneumatic impact mechanism also results in breaking up and partial falling out of the soil sample which renders it impossible to use a reversible impact mechanism designed for both driving the device into the ground and lifting it out of the hole.

Also known in the prior art are soil sampling devices wherein the appliance for covering the cross-sectional area of the socket is made in the form of a number of curved plates equispaced around the circumference of the socket. The shape of the free ends of the plates in this appliance is selected so as to ensure the most complete covering of the socket cross-section when the ends of the plates meet. However, this device is also used for holding the sample column of a coherent soil because the device fails to ensure complete covering of the socket. Such devices are mostly used for drilling holes with rotary tools followed by cleaning of the hole.

An object of the present invention resides in eliminating the aforesaid disadvantages.

An object of the present invention is to provide a soil sampling device wherein the appliance for holding the soil sample allows sampling of both coherent and loose soils.

This object is accomplished by providing a soil sampling device which comprises a pneumatic impact mechanism rigidly connected with a soil sampling socket which is provided with an appliance located near the end of the socket and intended to hold the soil sample in the socket while the latter is being extracted from the hole wherein, according to the invention, the appliance is made in the form of an elastic inflatable element communicating with a source of compressed gas, and is accommodated in a circular groove on the inner surface of the socket while it is being driven into the ground, and closes completely the cross-sectional area of the socket when it is being extracted from the hole.

Such a device ensures complete covering of the cross-sectional area of the socket and holding of the soil sample regardless of the type and state of the soil. Besides, the socket with the sample can be extracted from the hole without stopping the impact mechanism, e.g. in case of a reversible impact mechanism.

It is recommended that the inflatable element is supplied with the compressed gas from the same source as the pneumatic impact mechanism, for which purpose the latter is provided with an adapter connected by a pipe with a channel made in the body of the socket and incorporating a closing element. This eliminates the necessity for an additional source of compressed gas thus promoting economy in the consumption of the compressed gas and ensuring compactness of the device.

It is also advisable that the pipe connecting the adapter with the inflatable element is provided with a non-return valve which prevents the escape of the gas from the inflatable element after its inflation.

In one of the modifications of the invention the channel in the body of the socket has a branch line in which are successively installed a closing element and a device for giving a sound signal to indicate that the socket is filled with soil. The provision of the closing element in the branch line makes it possible to deliver the gas into the signalling device immediately before the socket is filled with soil.

In another variant of the invention the socket bottom has a central axial hole accommodating a movable rod whose free end carries a plate with a diameter somewhat smaller than the inside diameter of the socket, the rod serving as a closing element of the channel for the delivery of the compressed gas to the inflatable element and of the branch line of this channel, both the channel and its branch line being provided with zones which pass through the bottom of the socket and cross its hole for the rod whose side surface has circular grooves for the passage of the gas when the grooves are aligned with corresponding zones which are covered by the side surface of the rod.

Thus, the rod with the plate fixes the required height of the soil sample column in the socket and serves simultaneously as the closing element of the channel delivering the compressed gas to the inflatable element and of the branch line.

In still another modification the plate is installed on the free end of the rod with the aid of a replaceable bushing which allows the position of the plate to be changed in the vertical plane to suit the required height of the sample column in the socket.

The soil sampling device according to the invention incorporates the earlier-explained appliance for holding the soil sample in the socket, the appliance ensuring complete and high-quality sampling irrespective of the type and state of the soil.

Now the invention will be described in detail with reference to the accompanying drawings, in which:

FIG. 1 is a partial axial longitudinal section of the lower part of an exemplary soil sampling device according to the invention;

FIG. 1′ is a similar sectional view of the upper part of the same device, the contiguous parts of FIGS. 1 and 1′ being connected along lines I—I and I′—I′, respectively;

The exemplary device according to the invention is designed for taking soil samples from the ground surface, from a hole already drilled by another method or device, and for drilling shallow holes. The device can be driven either vertically or at an angle.

Figure 1:
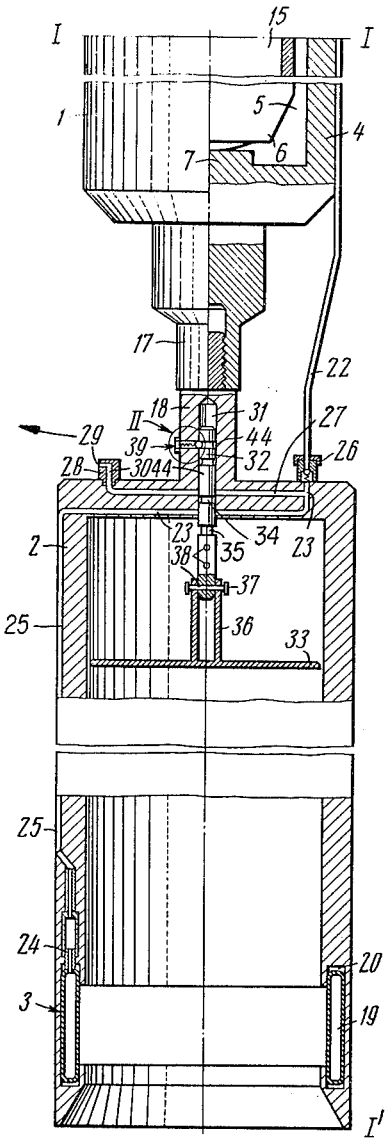
Figure 1:
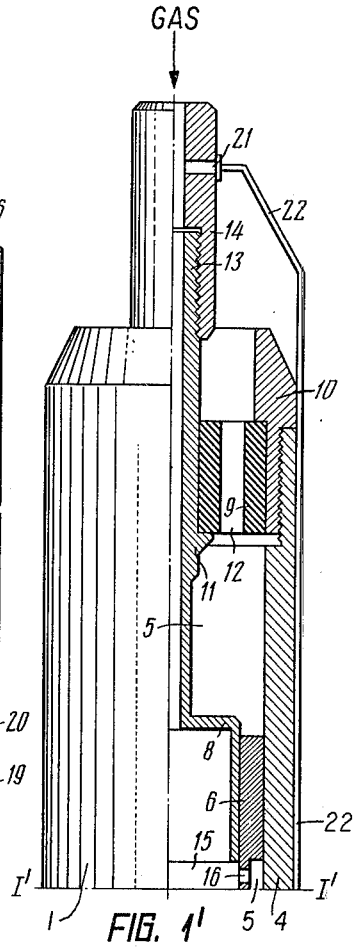

The soil sampling device comprises a pneumatic impact mechanism 1 (FIG. 1) used for driving the device into the ground, and a rigidly connected, preferably coxial soil sampling socket 2. The socket 2 has an appliance 3 located near its end, intended to hold a columnar soil sample therein while it is being extracted from the hole. The impact mechanism 1 can be of any known design used in devices of similar purpose. Here we shall describe the pneumatic impact mechanism 1 as consisting of a casing 4 with a cylindrical space 5 inside. The space accommodates a ram 6 installed with provision for a reciprocating motion. Located in the lower part (as shown in the drawing) of the space 5 is an anvil 7 made integral with the casing 4. The space 5 also accommodates a slide valve 8 which serves as a gas-distributing device. The slide valve 8 is a hollow stepped cylinder whose maximum-diameter portion is located in the lower part of the casing 4.

The slide valve 8 is secured in the casing 4 with the aid of a circular damper 9 which fits tightly around the slide valve 8. The damper 9 is pressed into a nut 10 which is secured in the upper part of the casing 4. The damper 9 rests on a shoulder 11 located on the external surface of the slide valve 8 and has through holes 12 arranged parallel to the axis of the slide valve 8 and intended to allow free escape of the gas from the space 5 of the casing 4 into the atmosphere. The slide valve 8 has an extension 13 which is brought out of the casing 4 and carries an adapter 14.

The adapter 14 is used for connecting a compressed gas supply hose leading to an appropriate source (not shown). The external surface of the lower part of the slide valve 8 matches with that ram 6 which has a cylindrical space 15 for the purpose. In this space the walls of the ram 6 have ports 16 arranged on the same level, uniformly around the circumference, and intended to put the space 15 of the ram 6 in communication with the space 5 of the casing 4.

An adapter 17 made integral with the lower part of the casing 4 serves for fastening the socket 2 for which purpose the latter has an integral extension 18 in the centre of its bottom. The extension 18 is connected with the adapter 17 by a screw joint.

The socket 2 intended to take the soil samples, has the appliance 3 associated therewith, intended to cover completely the cross-sectional area of the socket 2 and to hold the soil sample in it while it is being lifted out of the hole. To ensure better penetration into the ground, the edge of the socket 2 is pointed and is reinforced by an additional layer of metal.

The appliance 3 is made in the form of an elastic inflatable element 19 communicating with the source of compressed gas (not shown). While the socket 2 is being driven into the ground, the inflatable element 19 is located in a circular groove 20 on the inner surface of the socket 2. The inflatable element 19 has a toroidal shape and serves for closing completely the cross-sectional area of the socket 2 when inflated, and holding the sample in the socket while it is being lifted out of the hole.

The appliance 3 according to the invention can also be used in other devices for similar purposes.

The elastic element 19 is inflated from the same source which supplies the pneumatic impact mechanism 1. For this purpose the mechanism 1 is provided with the earlier-described adapter 14 installed on the extension 13 of the slide valve 8.

The wall of the adapter 14 has a channel 21 which connects its space with a pipe 22 leading from this channel. The pipe 22 is connected with a lower channel 23 made in the body of the socket 2 and used to deliver compressed gas to the inflatable element 19. There is a nipple 24 (see also FIG. 3) installed at the point where the channel 23 is connected with the element 19. The portion of the channel 23 passing along the generatrix of the socket 2 is in fact a pipe or channel 25 laid into a slot on the external surface of the socket 2. The channel 25 does not protrude above the surface of the socket 2.

The pipe 22 connecting the adapter 14 with the inflatable element 19 accommodates a non-return valve 26 which prevents the escape of gas from the inflatable element 19 after its inflation.

The channel 23 has an upper branch line 27 made in the body of the socket 2 and having an outlet hole on the surface of the socket. Installed at the outlet hole of the branch line 27 is a sound signalling device 28 made in the form of a cylinder which is secured on the surface of the socket 2 and has two intersecting channels 29 and 30, the channel 30 being a continuation of the branch line 27 while the channel 29 discharges the gas into the atmosphere. The sound signal 28 indicates that the socket 2 is filled with soil.

The bottom of the socket 2 and the adjoining extension 18 have a central axial hole 31 for an axially movable rod 32 whose free end carries a plate 33 with a diameter somewhat smaller than the inside diameter of the socket 2. The rod 32 with the plate 33 serves to fix the required height of the sample column in the socket 2. Besides, the rod 32 serves simultaneously as a closing element of the channel 23 that delivers the compressed gas to the inflatable element 19 and the branch line 27, both the channel 23 and its branch line 27 being provided with zones which pass through the bottom of the socket 2 and cross its hole 31.

The side surface of the rod 32 has lower circular or annular grooves 34 and 35 for the passage of the gas when one of these grooves is aligned with the corresponding zone of the channel 23 and the branch line 27 respectively, which are covered by the side surface of the rod 32. The respective distances between channels 23, 27 and grooves 35, 34 are such that only one channel can be made to communicate at any time (first line 27 through groove 34, and later channel 23 through groove 35).

A replaceable bushing 36 installed on the free end of the rod 32 is intended to change the position of the plate 33 in the socket 2 to suit the required height of the sample column. The other end of the bushing 36 carries the plate 33. The bushing 36 is fixed on the rod 32 by means of a pin 37 passing through one of holes 38 made in the rod 32 perpendicularly to its axis.

Figure 2:
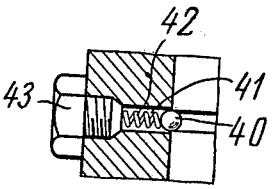
FIG. 2 shows a fragment II in FIG. 1, enlarged.

The rod 32 is held in the hole 31 by means of a lock 39 which consists of a ball 40 (FIG. 2) with a spring 41, both being installed in a through hole 42 of the extension 18, the hole being closed with a plug 43. In view of the fact that the rod 32 together with the replaceable bushing 36 comes to two fixed positions during operation, the side surface of the rod 32 has two upper circular or annular grooves 44 of a semi-circular profile corresponding to the diameter of the ball 40. The upper groove 44 in the pair (FIG. 1) is provided for the position of the rod 32 before operation, in respect of lock 39, while the lower groove 44 corresponds to the position occupied by the rod 32 after the socket 2 has been filled with the soil sample of the required height.

In the initial position before work, the device is set in the required direction to the ground surface or lowered into the previously made hole. The ram 6 rests on the anvil 7 and its ports 16 communicate the lower part of the space 5 with the space 15 of the ram 6.

The rod 32 with the replaceable bushing 36 occupies the lower position and the ball 40 of the lock 39 enters the upper groove 44. The inflatable element 19 is empty and is located in the circular groove 20 of the socket 2.

The device functions as follows. Compressed gas flows from the source through the adapter 14 and the slide valve 8 and further through the ports 16 in the wall of the ram 6 into the circular gap formed by the surface of the space 5 of the casing 4 and the external surface of the ram 6. Due to the difference of the gas pressures applied to the lower surface of the ram 6 and to the bottom of the space 15 which have different areas, the ram 6 starts moving upward. During its upward movement, the side surface of the slide valve 8 covers the ports 16, thus cutting off the supply of gas into the lower part of the space 5.

Further upward movement of the ram 6 continues due to expansion of the compressed gas in the lower part of the space 5. The ram continues moving upward until its ports 16 come above the maximum-diameter portion of the slide valve 8. Then the compressed gas starts flowing from the lower part of the space 5 into its upper part and escapes into the atmosphere through the holes 12 in the damper 9 which marks the discharge of the used gas.

At this moment the pressure of gas in the space 15 of the ram 6 is considerably higher than the (atmospheric) outside pressure so that the downward stroke of the ram 6 is effected due to the difference of these pressures, also aided by its own weight, and ends when the ram 6 strikes the anvil 7 and thus drives the socket 2 into the ground.

At the moment of impact the ports 16 of the ram 6 again put the lower part of the casing space 5 in communication with the space 15; as a result, the lower part of the space 5 is filled with compressed gas and the ram 6 again goes upward, thus repeating the operating cycle of the impact mechanism 1.

The operating cycles of the impact mechanism are repeated until the column of soil reaches the plate 33 secured on the bushing 36 fastened on the rod 32. Then the soil column begins raising the plate 33 together with the rod 32 until the upper groove 34 gets in line with the upper branch line 27. Groove 35 does not reach channel 23 at this time. As a result, the compressed gas flows through the channel 21 of the adapter 14 into the pipe 22 and passes through the non-return valve 26 into the branch line 27 and further to the sound signalling device 28.

During the further upward movement of the soil column and, consequently of the rod 32, the groove 34 moves away from and past the branch line 27 while the lower groove 35 gets in line with the lower channel 23. At the same moment the ball 40 of the lock 39 snaps into the lower groove 44, fixing the rod 32 in the uppermost position. The compressed gas through channel 21, pipe 22 and valve 26 now reaches the channel 23 and thence channel 25 after which it enters the inflatable element 19 through the nipple 24.

Immediately after the sound signal is given (by way of the connection established between groove 34 and line 27) by the device 28 to indicate that the socket 2 is full, the supply of compressed gas to the impact mechanism 1 is cut off after which a small amount of compressed gas is delivered (by way of the connection established between groove 35 and channel 23), into the element 19, just sufficient for its inflation.

After the delivery of compressed gas is cut-off the nonreturn valve 26 automatically closes thus preventing the gas from escaping from the element 19.

In case of loose and friable soils the inflatable element 19 will close the entire cross-sectional area of the socket 2 or, in case of a comparatively compact soil, it will compress the column of soil, thus making a plug which is capable of holding the sample above it.

Figure 3:
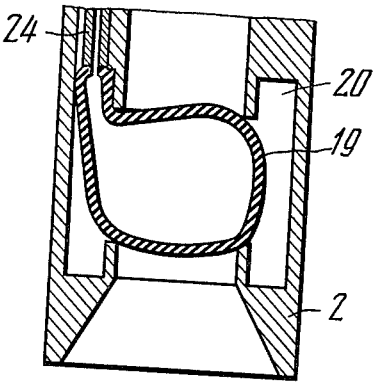
FIG. 3 is a partial longitudinal axial section through an elastic inflatable element when it closes the cross-sectional area of a socket.

If the soil plug falls out, the inflatable element 19 will close completely the cross-sectional area of the socket 2, as it is shown in FIG. 3. Then the device is lifted out of the hole by a winch (not shown) and the soil sample is taken out of the socket 2. For this purpose the socket 2 is disconnected from the impact mechanism 1 and the pipe 22, after which the compressed gas escapes from the inflatable element 19 into the atmosphere through channel 25, channel 23 and non-return valve 26. Then the device is carried to the site where the next sample is to be taken, the socket 2 is again connected and the device is lowered into the hole for deepening it.

Thus, the device according to the invention makes it possible to take complete and high-quality samples even of friable and loose soils.

What is claimed is:

1. A soil sampling device comprising: a pneumatic impact mechanism; a socket for taking substantially columnar soil samples, rigidly connected with said impact mechanism; said socket having a body portion with an inner side surface near its free end, which is provided with a groove defining an annular recess;

means for holding the soil sample in said socket when the latter is extracted from the ground, in the form of an elastic inflatable element, connectable to a source of compressed gas, said element being located in said recess when said socket is driven into the ground, and covering completely the inner cross-sectional area of said socket when the latter is extracted from the ground; and a conveying and controlling system for the compressed gas, including a channel in said body portion of the socket to communicate said inflatable element with said source, and a non-return valve also included in said system, to prevent leakage of the gas from said inflatable element after it is inflated; as well as a branch line further included in said system, with which line is associated with said non-return valve, and a signaling device to which the compressed gas is also supplied, to indicate that said socket is filled with the soil sample.

2. The device as defined in claim 1, wherein the bottom of said socket has a central axial hole accommodating an axially movable rod whose free end carrier a plate with a diameter somewhat smaller than the inside diameter of said socket, said rod cooperating with said conveying and controlling system, to act as a closing element for said first-named channel that delivers the compressed gas to said inflatable element, and alternatively for said branch line, both the latter and said channel having sections which pass through said bottom of the socket and cross said axial hole, a side surface of said rod being provided with annular grooves for the selective passage of the gas when said grooves are respectively aligned with corresponding ones of said sections, which are covered by said side surface of the rod.

3. The device as defined in claim 2, wherein said plate is installed on said free end of the rod with the aid of a replaceable and adjustable bushing that serves to change the position of said plate in a plane perpendicular to the axial direction of said rod to suit the required height of the columnar soil sample in said socket.

* * * * *